US007931292B2

(12) United States Patent
Miralles

(10) Patent No.: US 7,931,292 B2
(45) Date of Patent: Apr. 26, 2011

(54) SOLE FOR A CROSS-COUNTRY SKI BOOT INCLUDING CONNECTORS FIXED TO THE SOLE, AND A BOOT PROVIDED WITH SUCH A SOLE

(75) Inventor: Thierry Miralles, Marcellaz Albanais (FR)

(73) Assignee: Salomon S.A.S., Metz-Tessy (FR)

( * ) Notice: Subject to any disclaimer, the term of this patent is extended or adjusted under 35 U.S.C. 154(b) by 835 days.

(21) Appl. No.: 11/696,971

(22) Filed: Apr. 5, 2007

(65) Prior Publication Data

US 2007/0235984 A1 Oct. 11, 2007

(30) Foreign Application Priority Data

Apr. 7, 2006 (FR) ..... 06 03069

(51) Int. Cl.
*A63C 9/085* (2006.01)
*A63C 9/081* (2006.01)
*A43B 5/04* (2006.01)

(52) U.S. Cl. ..... 280/615; 280/611; 280/613; 280/618; 36/117.2; 36/117.3

(58) Field of Classification Search ..... 280/11.224, 280/611, 613, 615, 618, 623, 607, 634; 36/115, 36/117.2, 117.3, 131
See application file for complete search history.

(56) References Cited

U.S. PATENT DOCUMENTS 4,334,367 A * 6/1982 Salomon ..... 36/117.2
4,553,771 A * 11/1985 Bernard et al. ..... 280/615
4,836,572 A * 6/1989 Pozzobon ..... 280/613
4,840,086 A * 6/1989 Bidal ..... 74/594.6
4,907,353 A * 3/1990 Wittmann et al. ..... 36/117.2
4,930,233 A 6/1990 Provence
5,085,454 A 2/1992 Provence et al.
5,108,125 A * 4/1992 Callegari ..... 280/615
5,224,729 A 7/1993 Provence et al.
5,899,006 A 5/1999 Donnadieu
5,924,719 A 7/1999 Girard
5,941,553 A * 8/1999 Korman ..... 280/613
D414,596 S * 10/1999 Donnadieu et al. ..... D2/960
6,017,050 A 1/2000 Girard
6,065,769 A * 5/2000 Simonetti et al. ..... 280/615
6,120,038 A * 9/2000 Dong et al. ..... 280/7.13

(Continued)

FOREIGN PATENT DOCUMENTS

DE 4003967 A1 * 10/1990
EP 72766 A1 * 2/1983
EP 0 768 103 A1 4/1997

(Continued)

*Primary Examiner* — Terrell Mckinnon
*Assistant Examiner* — Chiedu A Chibogu
(74) *Attorney, Agent, or Firm* — Greenblum & Bernstein, P.L.C.

(57) ABSTRACT

A flexible sole for a cross-country ski boot and a cross-country ski boot having such sole. The sole includes at least two members for connecting the boot to a binding device, the connecting members including portions anchored in the sole, the connecting members being fixed to a common anchoring element, the anchoring element being affixed to a predetermined section of the sole, the anchoring element including two anchoring zones, each connecting member being fixed to one of the anchoring zones, and the anchoring element including a central zone extending between the two anchoring zones, such central zone of the anchoring element being sufficiently flexible to enable, during the use of the boot, the bending of the predetermined section of the sole to which the anchoring element is affixed.

43 Claims, 6 Drawing Sheets

U.S. PATENT DOCUMENTS

| | | | | |
|---|---|---|---|---|
| 6,216,366 | B1 | 4/2001 | Donnadieu | |
| 6,289,610 | B1 * | 9/2001 | Girard et al. | 36/117.2 |
| 6,347,805 | B1 * | 2/2002 | Maravetz et al. | 280/624 |
| 6,374,517 | B2 | 4/2002 | Girard et al. | |
| 6,390,493 | B1 * | 5/2002 | Hauglin | 280/615 |
| 6,481,121 | B1 * | 11/2002 | Tucker | 36/62 |
| 6,536,795 | B2 * | 3/2003 | Okajima et al. | 280/613 |
| 6,644,683 | B1 * | 11/2003 | Hauglin et al. | 280/613 |
| 6,964,428 | B2 | 11/2005 | Quellais et al. | |
| 2002/0092207 | A1 * | 7/2002 | Girard et al. | 36/117.3 |
| 2006/0012152 | A1 | 1/2006 | Quellais et al. | |
| 6,168,184 | B1 | 1/2001 | Simonetti et al. | |

FOREIGN PATENT DOCUMENTS

| | | | | |
|---|---|---|---|---|
| EP | 0 787 440 | A1 | | 8/1997 |
| EP | 0 913 103 | B1 | | 5/1999 |
| EP | 1 440 713 | A1 | | 7/2004 |
| EP | 1 559 457 | A1 | | 8/2005 |
| FR | 2 626 448 | A1 | | 8/1989 |
| FR | 2 634 132 | A1 | | 1/1990 |
| FR | 2642980 | A1 | * | 8/1990 |
| FR | 2 645 038 | A1 | | 10/1990 |
| GB | 2239780 | A | * | 7/1991 |
| WO | WO 9409660 | A1 | * | 5/1994 |

* cited by examiner 10
46
14
12
24
26
IX
IX
20
16
28
21
34
18
32
36
11
22
30

10
62
46
26
14
21
18
34
32
30
36
11
16
28
20
24

60
18
54
56
46
58
21
48
60
16
62
52
20
56
64
58
48

48
58
52
58
16
56
46
20
60
60
48
48
21
54
18

SOLE FOR A CROSS-COUNTRY SKI BOOT INCLUDING CONNECTORS FIXED TO THE SOLE, AND A BOOT PROVIDED WITH SUCH A SOLE

CROSS-REFERENCE TO RELATED APPLICATION

This application claims priority under 35 U.S.C. §119 of French Patent Application No. 06.03069, filed on Apr. 7, 2006, the disclosure of which is hereby incorporated by reference thereto in its entirety.

BACKGROUND OF THE INVENTION

1. Field of the Invention

The invention relates to the field of cross-country ski boots and related footwear.

2. Description of Background and Relevant Information

The expression cross-country skiing, at least as used herein, refers not only to cross-country skiing, but to its direct derivative, back-country skiing, which requires the use of similar equipment, devices, although the binding devices are typically larger than those used in the more traditional cross-country skiing, in order to withstand greater forces/pressures, and the boots are higher and generally provide greater warmth. These ski-related sports are different from alpine skiing or telemark skiing in that they are practiced on terrain that is not particularly rugged and can be practiced with boots having flexible soles.

The documents EP-913103 and U.S. Pat. No. 6,289,610 disclose a sole for a sports footwear, particularly for cross-country skiing, which includes two members for connecting the boot to a binding of a cross-country ski. In the examples disclosed in these documents, each of the connecting members, or connectors, is independently anchored in the sole. To this end, they each include anchoring portions onto which the sole is directly overmolded. This anchoring system works perfectly insofar as the material used to make the sole has good mechanical properties, particularly in terms of tensile strength in traction, in order to prevent the connecting members from being separated during use. Thus, this anchoring system works well with materials having a tensile strength in traction greater than about 30-35 MPa.

With products of lower performance (but which are, for example less costly to manufacture, easier to implement, and/or have better adherence properties), the risk of separation of the connecting members from the sole increases substantially.

The document U.S. Pat. No. 4,907,353 discloses a solution, which makes it possible to avoid any risk of separation from the connecting member. The connecting member, or "hooking element," is anchored in a massive anchoring element made of a hard resistant material and overmolded with the material of the sole.

Another solution is disclosed in the document FR-2645038 in which the connecting member is fixed to an anchoring element in the shape of a metal plate on which the material of the sole is overmolded.

The solutions described in the aforementioned two documents are interesting but cannot be transferred to a sole provided with two connecting members, rather than one. Indeed, as shown in the document EP-913103 mentioned above, to make a cross-country ski boot, one having ordinary skill in the art seeks to preserve as much flexibility as possible for the sole in the location that corresponds to the metatarsophalangeal articulation zone of the skier's foot, as well as in the area between the front of this zone and the front end of the sole. This flexibility is required to ensure a proper boot rolling movement, i.e., a movement which might be said to simulate the natural movement of the foot during movement. Therefore, the solutions described above are valid when the connecting member is anchored at the very front end of the sole, but would not be valid if they were directly transposed to anchoring a connecting member, or a pair of such members, located further toward the rear, particularly at the metatarsophalangeal zone, or slightly forward of such zone.

SUMMARY OF THE INVENTION

The invention provides for a new sole structure, which ensures that the connecting member(s) is(are) reliably anchored without overly rigidifying the sole in the portion of the sole in which the connecting member(s) is(are) anchored.

To this end, the invention provides for a flexible sole for a cross-country ski boot including at least two members for connecting the sole to a binding device, such connecting members including anchoring portions in the sole, the connecting members being fixed to a common anchoring element that is affixed to the sole, the anchoring element including two anchoring zones, each connecting member being fixed to one of the anchoring zones, and the anchoring element including a central zone, which extends between the two anchoring zones and which is flexible so as to enable, during the use of the boot, a flexion of the sole section to which the anchoring element is affixed.

BRIEF DESCRIPTION OF DRAWINGS

Other characteristics and advantages of the invention will be better understood from the detailed description that follows, with reference to the annexed drawings, in which.

DETAILED DESCRIPTION OF THE INVENTION

The invention is described in the context of a binding device 12 for a cross-country ski 11 enabling the front end of a cross-country ski boot 10 to be connected to the ski while the rear end thereof remains free to be raised and lowered relative to the ski. See FIGS. 3 and 4.

Figure 1:
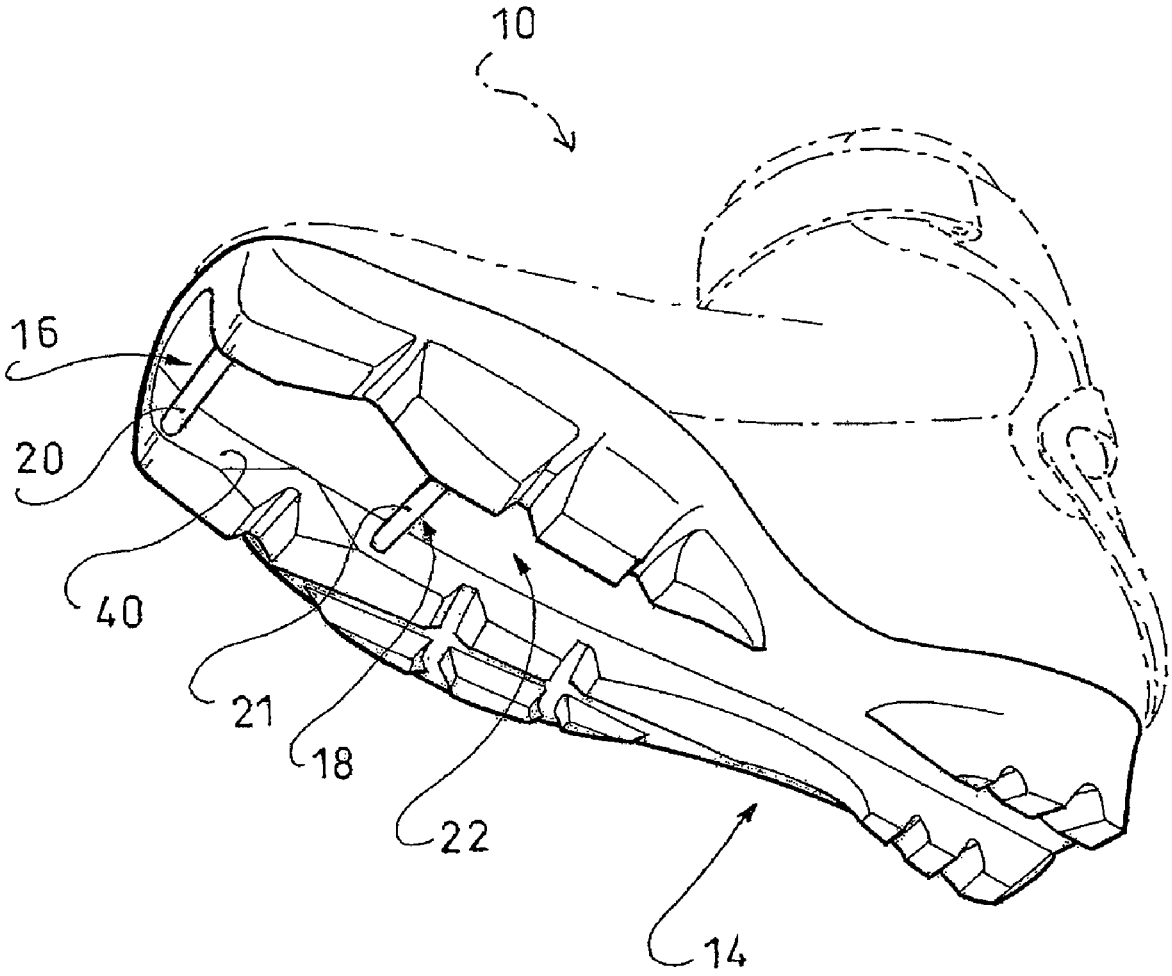
FIG. 1 is a schematic, perspective, bottom view of a sole for a cross-country ski boot; the boot upper being shown in dot-and-dash line.
Figure 2:
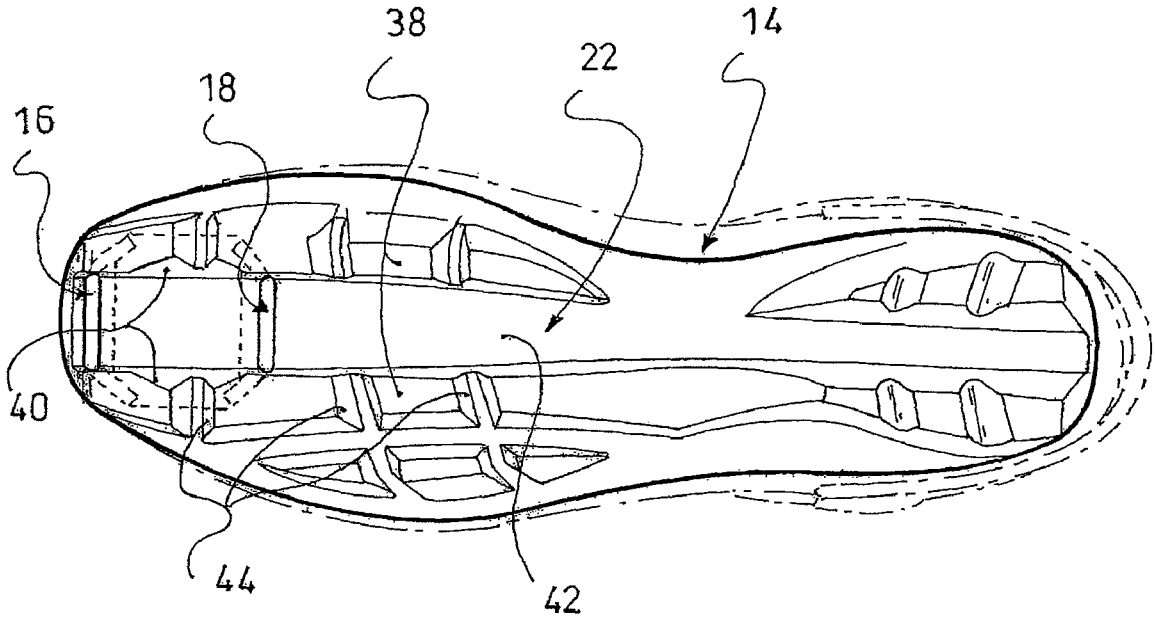
FIG. 2 is a bottom view of the sole of FIG. 1.

The boot shown in FIGS. 1 and 2 includes a sole 14 in which two connecting members 16, 18 are anchored and arranged in the sole 14 so as to be flush beneath the latter.

Thus, each connecting member 16, 18, in the non-limiting illustrated embodiment, takes the form of a cylindrical rod 20, 21 that extends across a longitudinal groove 22, the groove having a gradual tapered transverse cross-section extending within the lower surface of the sole 14. Stated another way, the longitudinal groove 22 has a height that opens to the lower extent of the sole 14 and each of the two connecting members 16, 18 have active portions, i.e., portions exposed to connection with a binding device, which extend transversely across the groove, such active portions being entirely contained within the height of the groove.

The front rod 20 of the embodiment depicted in FIGS. 1 and 2 is located, for example, in the vicinity of the front end of the sole, and the rear rod 21 is offset rearward by a predetermined distance so as to be located in the area of a zone of the boot that corresponds to the metatarsophalangeal bending/flexion/articulation zone of the wearer's foot, or in an area at the front of such zone. In a particularly advantageous embodiment, the rear rod 21 is moved back no farther than the rear limit of the first third portion of the length of the boot, which constitutes the end rear limit of the aforementioned metatarsophalangeal zone. This arrangement of the connecting members is particularly useful in cross-country skiing because it makes it possible, with a boot provided with a longitudinally flexible sole, to maintain a longitudinal flexing of the boot corresponding to that of the foot.

Although the illustrated embodiment shows the connecting members, or connectors, as cylindrical rods, i.e., rods having a circular cross section, other shapes are encompassed within the scope of the invention which would allow the rear of the boot to be raised and lowered while the front of the boot is connected to the ski by means of such connecting members. Examples of such other shapes include non-circular cross sections, hooks, etc.

Figure 3:
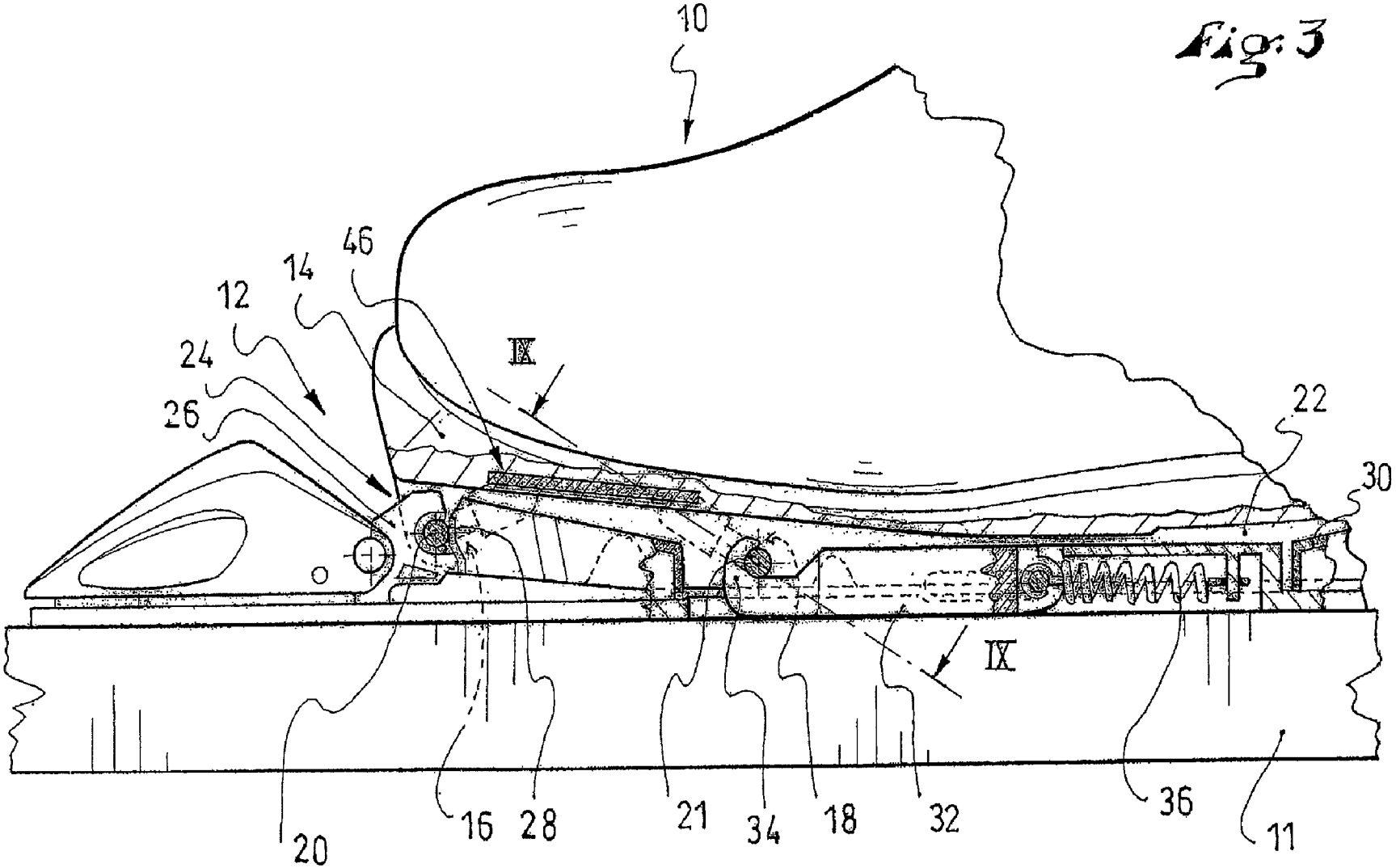
FIG. 3 is a cross-sectional, longitudinally side view of a boot provided with a sole according to the invention, the boot being connected to a device for binding it to a cross-country ski, the boot being supported upon the ski.
Figure 4:
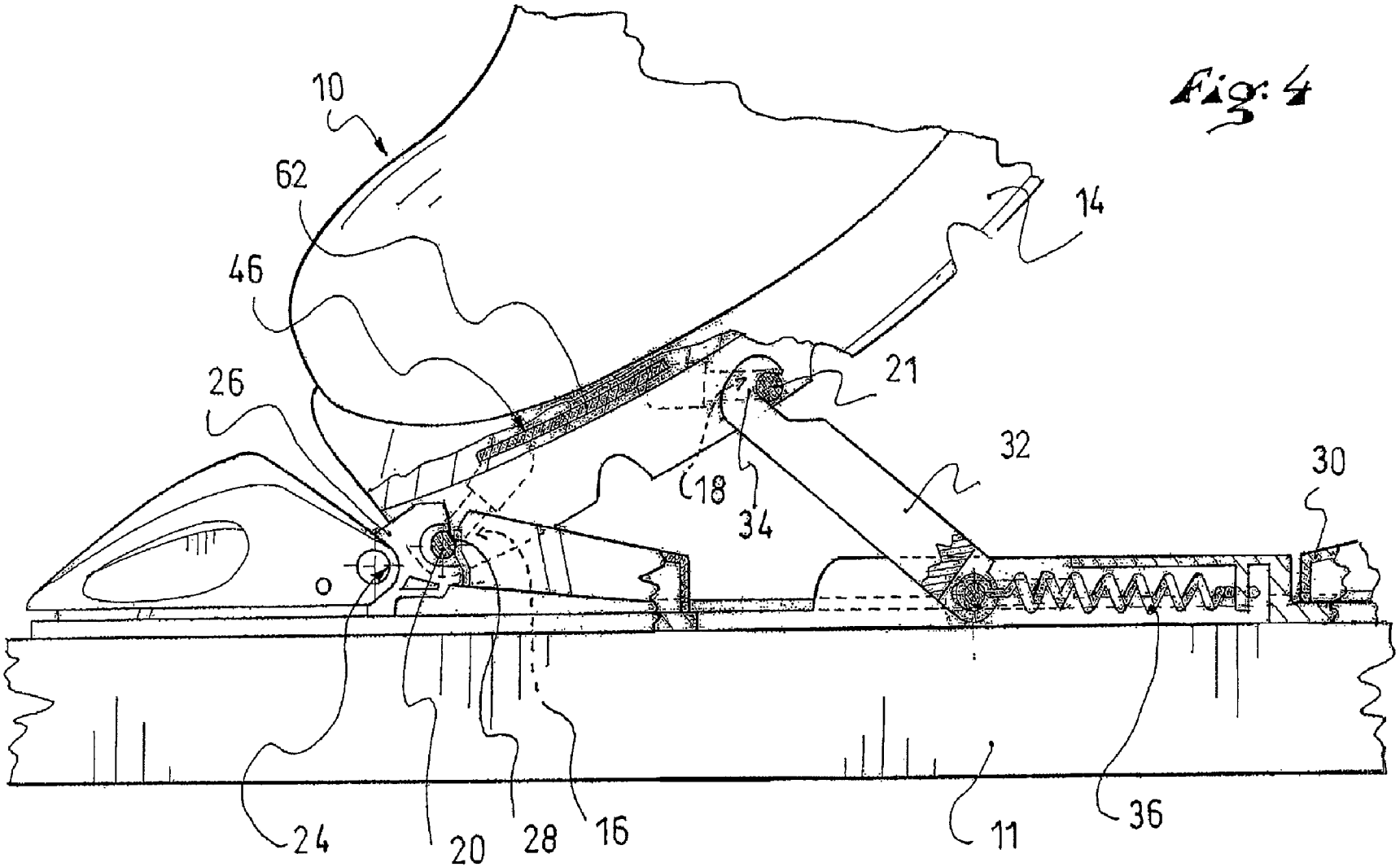
FIG. 4 is a view similar to that of FIG. 3, in which the heel of the boot is in a raised position.

In the example shown and described, particularly in FIGS. 3 and 4, the rod 20 of the front connecting member 16 is adapted to cooperate, in a known manner, with a locking mechanism 24 including a hook-shaped movable jaw 26 and a transverse edge 28 constituting a fixed jaw for the rotary locking of the boot on the ski 11. Once locked in the locking system, the rod 20 of the front connecting member 16 can freely pivot inside, i.e., rotate within, the jaw 26, thus ensuring an articulated fastening of the front end of the boot 10. The functioning principle of the locking mechanism 24 is well-known, per se, from the prior art, for example in the commonly owned documents FR 2 634 132 and U.S. Pat. No. 5,085,454, the disclosure of the latter of the two documents being hereby incorporated by reference thereto in its entirety. The locking mechanism can be either manual or automatic. An example of such a locking mechanism is implemented in the systems marked by Salomon S.A. under the tradename "SNS", although the invention can be implemented with other types of locking mechanisms.

The rod 21 of the rear connecting member 18 is adapted to allow the boot to be connected to an elastic return mechanism integrated into a guiding rib/ridge 30 of the device. The guiding rib 30, which extends longitudinally rearwardly from the locking mechanism and, in a particularly advantageous embodiment, has a profile in cross-section corresponding to that of the groove 22. However, other transverse cross-sectional shapes for the rib 30 and the groove 22 are possible. The elastic return system can be identical to that disclosed in the commonly owned documents EP 768103 and U.S. Pat. No. 6,017,050, the disclosure of the latter of the two documents hereby being incorporated by reference thereto in its entirety, although other such systems could be implemented. The elastic return system, thus, includes a connecting rod 32 having a hook-shaped front end 34 (adapted to hook onto the rear rod 21 of the boot 10), and a rear end connected to the base so as to be able to slide longitudinally and to pivot about a transverse axis. One or more elastic return members 36 bring the connecting rod 32 back to the resting position shown in FIG. 3. This way, when the heel of the boot is lifted such as shown in FIG. 4, by pivoting the boot 10 about its front rod 20, the connecting rod 32, hooked to the rear rod 21 of the boot, can follow the upward and frontward displacement of the rear rod 21 while exerting thereon a return force that brings the sole 14 of the boot 10 back toward the upper surface of the ski 11.

The invention can alternatively be implemented for other binding devices, such as a binding device of the type described in the document EP 1440713 and U.S. Pat. No. 6,964,428, the disclosure of the latter of the two documents hereby being incorporated by reference thereto in its entirety. Alternatively, the invention can be implemented for other types of binding devices, such as, for example, devices that are at least partially integrated into the ski.

As can be seen in FIGS. 1 and 2, the groove 22 of the sole 14 of the boot is transversely demarcated by tread blocks 38, which are arranged on both sides of the groove 22 and which constitute projections of the lower surface 42 of the sole extending downwardly to tread surfaces, which lower surface 42 also defines the bottom of the groove 22. Thus, the tread blocks 38 have facing inner lateral surfaces 40, which form the lateral surfaces of the groove 22. The tread blocks 38, which advantageously form a unitary element with the sole, are traversed by slits, particularly substantially transversely oriented slits 44, which maintain the flexibility of the sole to follow the foot rolling movement. One of the slits 44 is arranged between the two connecting members 16, 18 to maintain the longitudinal flexibility of the sole, including in the area of the sole between the connecting members. In fact, FIGS. 1 and 2 show one slit 44 on each side of the groove 22 located rearward of the front connecting member 16 and forward of the rear connecting member 18. In the illustrated embodiment, these two slits are transversely aligned, i.e., co-extensive.

Figure 5:
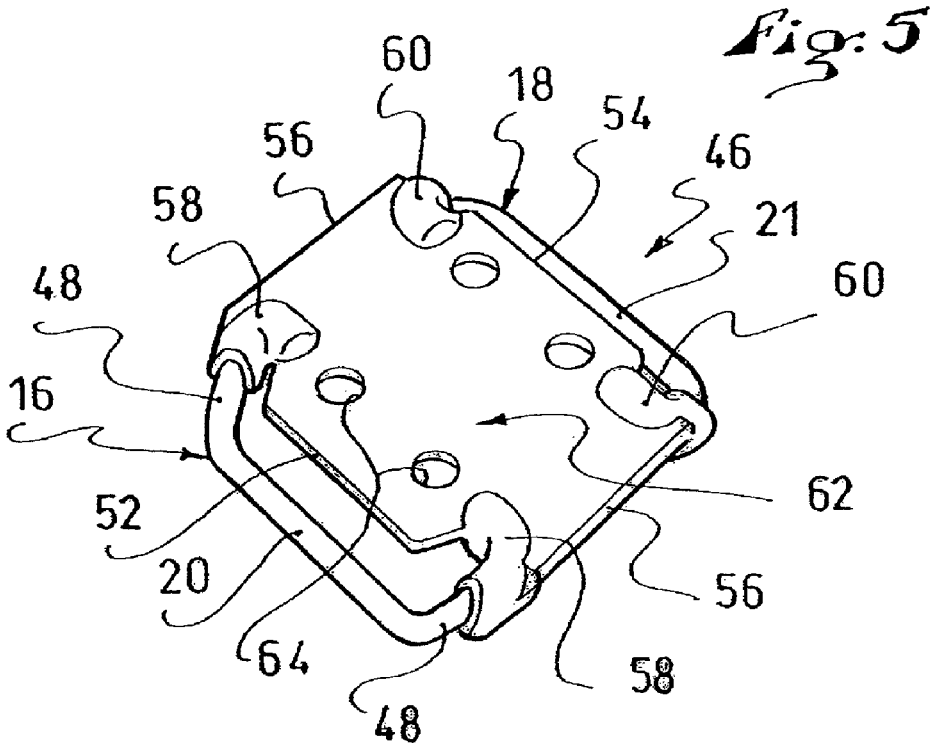
FIGS. 5 and 6 are perspective top and bottom views, respectively, of the anchoring element overmolded on the two connecting members.
Figure 6:
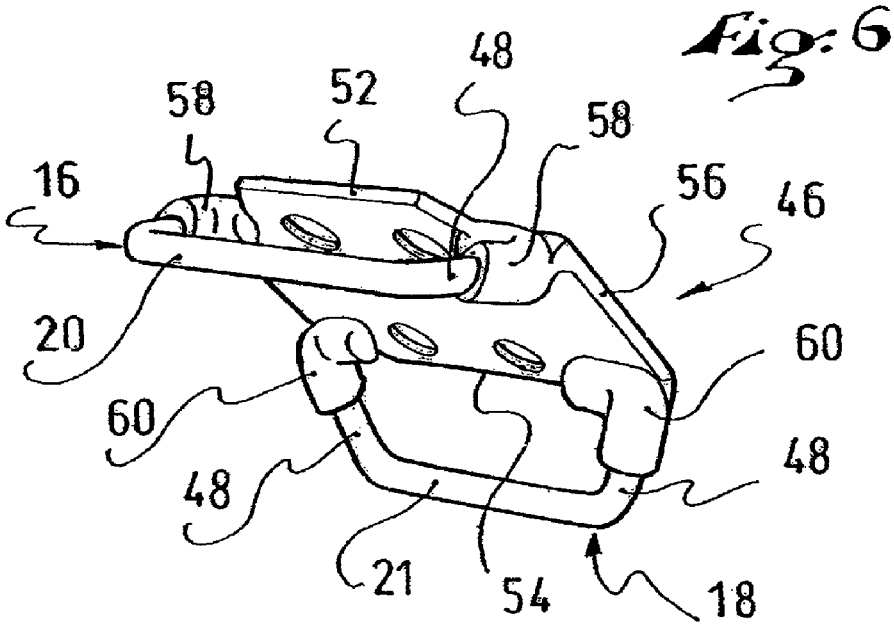

According to an advantageous embodiment of the invention, anchoring the connecting members 16, 18 into the sole requires an anchoring element 46, or anchoring part, that is common to the two connecting members, i.e., the two connecting members are affixed to the same anchoring element/part. An exemplary embodiment of the anchoring element 46 is shown in FIGS. 5 and 6.

In the example shown, each of the two connecting members 16, 18 has the same configuration as the other. Therefore, for each member, the transverse rod 20, 21 is extended at its two ends by a lateral arm 48 oriented along a substantially perpendicular direction (or along the same angle with respect to the transverse rod, for example according to a substantially V-shaped configuration), and each arm 48 includes a curved end 50, which is also perpendicular and in the direction of the arm, so that the curved ends 50 of the arms 48 of the same connecting member are oriented substantially along the same axis, facing one another. In this exemplary embodiment, each connecting member therefore extends substantially in a plane and includes a cylindrical rod, made of steel in an advantageous embodiment, shaped by bending.

In the illustrated example, the anchoring element has the shape of a substantially rectangular plate, the four corners of which are each overmolded on a curved end of one of the lateral arms of the two connecting members. In particular, the anchoring element 46 is made into a unitary, one-piece, element by molding, such as injection molding, from a plastic material. The anchoring element, thusly made, has a front rib 52, a rear rib 54, and two lateral ribs 56. The two corners of the front rib that are overmolded on the front connecting member therefore form a front anchoring zone 58 for the front connecting member 16. Similarly, the two corners of the rear rib that are overmolded on the rear connecting member therefore form a rear anchoring element 60 for the rear connecting member 18.

The anchoring zones 58, 60 cover the entire curved end 50 and slightly extend down along the upper portion of the corresponding lateral arm 48. The anchoring zones 58, 60 of the anchoring element 46 have, due to their overmolded construction, a shape that depends upon the shape of the curved ends 50 of the connecting members. Similarly, the front rib 52 and the rear rib 54 of the anchoring element 46 slightly project toward the front and rear, respectively, with respect to the curved ends of the front 16 and rear 18 connecting members, respectively. The front rib projects slightly farther than the rear rib. These projections allow the anchoring surface of the anchoring element in the material of the sole to be augmented. However, the projections could alternatively be the same at the front and rear, or there could even be no projection. Generally speaking, the anchoring element could have any other shape than that shown in the drawings.

Advantageously, each connecting member 16, 18 is implanted with its plane oriented at a 45 degree angle, or at an approximately 45 degree angle, with respect to the general orientation of the plate-shaped anchoring element. The front connecting member 16 is upwardly oriented from front-to-rear, whereas the rear connecting member 18 is downwardly oriented from front-to-rear. As a result, for a longitudinal spacing of 50 mm between the front 20 and rear 21 rods (which form the active portions of the connecting members 16, 18), the spacing of the anchoring zones of the intermediary element is only on the order of 25 mm. Therefore, the total length of the anchoring element 46, including the projections of the front and rear ribs with respect to the anchoring zones, is only on the order of 40 mm, for a 50 mm spacing of the rods 20, 21, at rest, that is, when the sole is not flexed. Thus, the inclined arrangement of the connecting members, while making it possible to reduce the length of the anchoring element, diminishes the negative impact that the anchoring element has on the bending capability of the sole.

Figure 9:
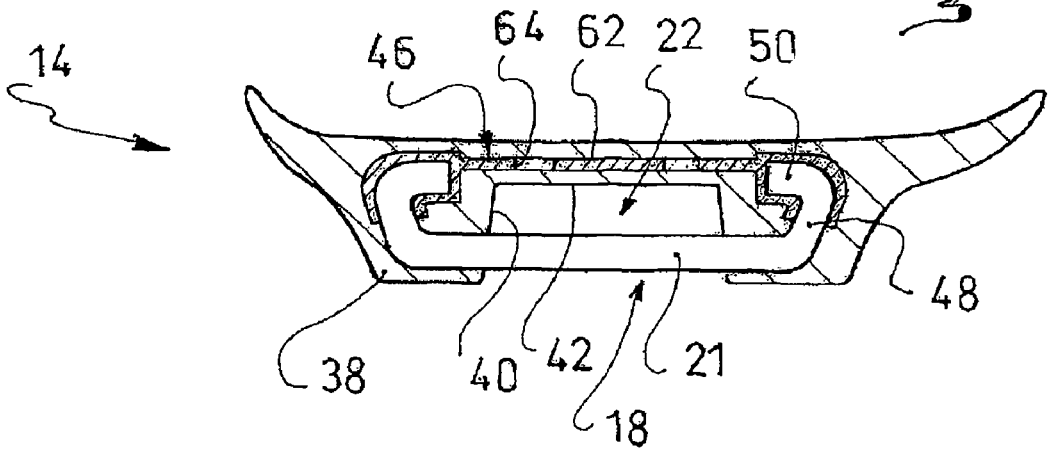
FIG. 9 is a cross-sectional view along the line IX-IX of FIG. 3.

Between the two anchoring zones 58, 60, the anchoring element 46 has a central zone 62, which, in the example shown, is a mere plate. For example, as shown in FIGS. 5 and 6, the thickness of the central zone extends transversely no further than within a single plane, i.e., from a first of the lateral ribs 56, or edges, to a second of the lateral ribs/edges. In some areas, however, the central plate 52 include four through holes 64. As shown in FIGS. 3, 4, and 9, the anchoring element 46 is adapted to be imbedded within the sole.

The sole 14 is a unitary element, e.g., over the length of the boot (but the invention could be implemented with a sole made of several portions, i.e., comprises more than one constituent material, for example with a flexible front portion and a rigid rear portion, such as described in the documents EP 787440 and U.S. Pat. No. 5,899,006, the disclosure of the latter of the two documents hereby being incorporated by reference thereto in its entirety) and is made, for example, of a thermoplastic synthetic rubber-based material. The material considered has a tensile strength in traction on the order of 12 MPa. The sole 14 is shaped by injection molding, which means that it is advantageous to provide for the anchoring element to be affixed to the sole by overmolding the sole around the anchoring element, so that the anchoring element is imbedded in the sole. However, the anchoring element could be affixed by other means such as gluing, welding, riveting, etc.

Advantageously, the two connecting members 16, 18 are fixed to the anchoring element 46 before the sole is made. Therefore, during the molding of the sole, not two but one component, formed by the assembly of the anchoring element and the two connecting members, need be positioned and maintained in the sole injection mold, thus making it easier to mold the sole.

As shown more particularly in FIG. 9, the assembly in its entirety is imbedded in the material of the sole, except for the transverse rods 20, 21 of the connecting members. The lateral arms 48 of the connecting members extend inside the tread blocks 38. The anchoring element is therefore not visible from the outside. Thus, only the transverse rods are visible, extending across the groove 22 by joining the two facing lateral surfaces 40 of the tread blocks 38. Furthermore, traversing holes 64 of the central zone of the anchoring element are filled with the sole material, which facilitates material flow during molding and improves the mechanical strength of the connection made between the anchoring element and the sole 14 by the overmolding.

Alternatively, the anchoring element could be at least partly visible outside the sole, especially in cases where it is not affixed to the sole by overmolding.

According to the invention, the anchoring element is designed such that it does not prevent the sole 14 from bending during use when the skier flexes his/her foot in support. This situation occurs particularly in the thrust phase during skiing. Further, the anchoring element itself is structured and arranged to bend in the section of the sole to which it is affixed, as the sole bends during use.

To this end, the central zone 62 of the anchoring element 46 is structured and arranged such that, depending upon the rigidity of its material, it can bend, i.e., flex, due to the forces exerted thereon during raising and lowering of the boot relative to the ski. Numerous combinations of configurations and materials are possible to obtain this result. In general, materials having an effective bending modulus lower than 6000 MPa, and particularly lower than 4000 MPa, are suitable for making the central plate 62, especially if the latter is thin.

In contrast with this function however, the anchoring element 46 must also be a reliable anchor for the connecting members 16, 18, which means that the anchoring zones 58, 60 of the anchoring element must not fail/break due to the forces transmitted to the connecting members during use of the boot. This is all the more critical as the material of the sole has a relatively low mechanical strength, for example a tensile strength in traction lower less than 30 MPa, or even less than 20 MPa. Various tests have shown that a material having a tensile strength in traction that is greater than 50 MPa makes it possible to obtain the strength required for the anchoring zones.

The anchoring zones 58, 60 and the central zone 62 of the anchoring element 46 must therefore fulfill contradictory mechanical strength properties.

An embodiment of the invention could have the anchoring element made of several portions, with a rigid material for the anchoring zones and a flexible material for the central zone. However, such a solution is more costly.

In the example shown, the anchoring element is therefore a unitary piece made of a single material. A material offering a satisfactory compromise has been defined, which requires the anchoring element to be made of polyamide 6 having a 15% glass fiber concentration. A completed element made of this material with a substantially constant wall thickness in the central zone 62 and in the anchoring zones 58, 60, a thickness between 1.0 mm and 2.5 mm, has yielded good results in terms of bending capability as well as in terms of tear-resistance of the connecting members. In an alternative embodiment, the wall thickness of the central zone 62 can be within the range of between approximately 1.0 mm and approximately 2.5 mm.

Figure 7:
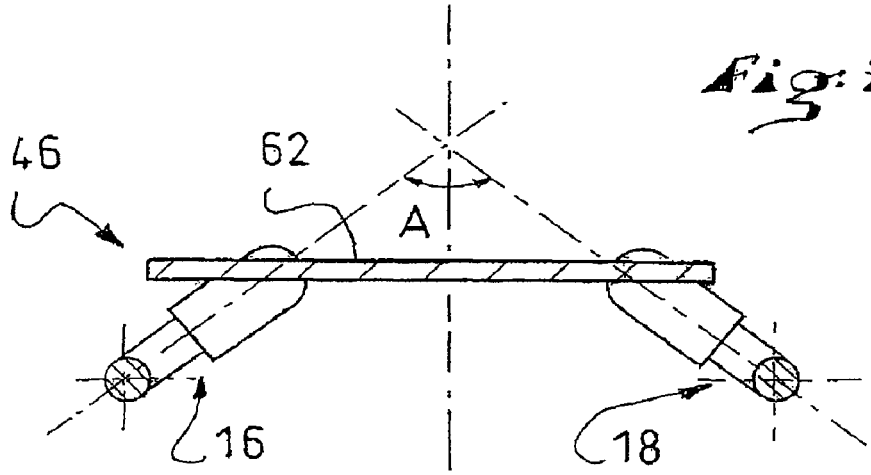
FIGS. 7 and 8 are cross-sectional views along a longitudinal plane, showing, in a schematic and exaggerated way, the deformation of the anchoring element while the boot is being used.
Figure 8:
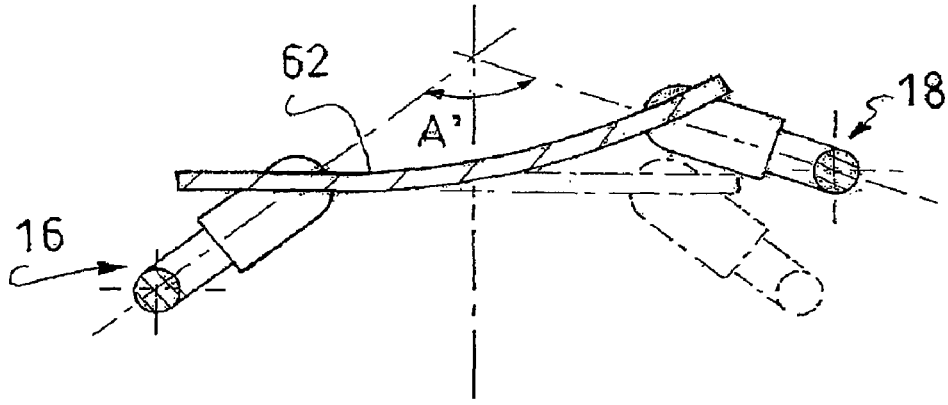

Under conditions that are similar to the conditions of use, the anchoring element 46 (and more particularly its central zone 62), implanted in a sole made of thermoplastic synthetic rubber, can possibly deform as generally shown in FIGS. 7 and 8, where the deformation has been voluntarily exaggerated for exemplification purposes.

Therefore, between a configuration at rest, as shown in FIG. 7 and a configuration withstanding a force as shown in FIG. 8, a relative displacement is observed between the two connecting members 16, 18. For example, the angle between the average planes of the two connecting members (angle measured in a longitudinal and vertical plane) can switch from a value A (on the order of 90 degrees, for example) to a value A' (on the order of 95 to 100 degrees) corresponding to a relative displacement whose rotational offsetting component is on the order of 5 to 10 degrees.

The invention claimed is:

1. A sole for a cross-country ski boot, said sole comprising:

two connecting members for connecting the sole to a binding device;

material of the sole, the two connecting members being anchored to the material of the sole;

each of the two connecting members further comprising anchoring portions anchoring the two connecting members in the material of the sole at respective positions along a length of the sole to allow a rear end of the sole to be raised and lowered relative to the ski during skiing when the connecting members are connected to the binding device;

an anchoring element, both of the two connecting members extending from the anchoring element, the anchoring element being distinct from but affixed to the material of the sole at a predetermined section of the sole;

the anchoring element comprising two anchoring zones, each of the anchoring portions of the two connecting members being fixed to a respective one of the two anchoring zones of the anchoring element;

the anchoring element further comprising a central zone, the central zone of the anchoring element extending between the two anchoring zones, the central zone of the anchoring element being flexible and sufficiently flexible relative to a flexibility of the material of the sole to enable a flexing of the predetermined section of the sole to which the anchoring element is affixed.

2. A sole according to claim 1, wherein:

during use of the boot, the flexing of the predetermined section of the sole, to which the anchoring element is affixed, causes a displacement of the two connecting members relative to each other.

3. A sole according to claim 2, wherein:

the relative displacement of the two connecting members corresponds to a relative angular offset of the two connecting members of at least 5 degrees.

4. A sole according to claim 1, wherein:

the central zone of the anchoring element is constituted by a flexible thin plate.

5. A sole according to claim 1, wherein:

the two anchoring zones of the anchoring element are arranged in a vicinity of two longitudinally spaced-apart ends of the anchoring element, the central zone of the anchoring element extending longitudinally between the two anchoring zones.

6. A sole according to claim 1, wherein:

the anchoring element is made of plastic material.

7. A sole according to claim 6, wherein:

at least one of the two connecting members is fixed to the anchoring element by having been overmolded to the anchoring element, comprising having molded the anchoring element from the plastic material over the anchoring portions of the at least one of the two connecting members.

8. A sole according to claim 6, wherein:

both of the two connecting members are fixed to the anchoring element by having been overmolded to the anchoring element, comprising having molded the anchoring element from the plastic material over the anchoring portions of the two connecting members.

9. A sole according to claim 1, wherein:

at least the central zone of the anchoring element is made of a material having a bending modulus less than 6000 MPa.

10. A sole according to claim 1, wherein:

at least the central zone of the anchoring element is made of a material having a bending modulus less than 4000 MPa.

11. A sole according to claim 1, wherein:

at least the two anchoring zones of the anchoring element are made of a material having a tensile strength in traction greater than 50 MPa.

12. A sole according to claim 1, wherein:

at least one of the two connecting members comprises an active portion projecting out of the material of the sole.

13. A sole according to claim 12, wherein:

the active portion of the at least one of the two connecting members comprises a transversely extending rod.

14. A sole according to claim 7, wherein:

each of the two connecting members comprises two lateral arms having curved ends to which the anchoring element is affixed.

15. A sole according to claim 1, wherein:

both of the two connecting members are located in a portion of the sole comprised between a front end of the sole and a zone of the sole corresponding to a metatarsophalangeal articulation zone of a wearer's foot.

16. A sole according to claim 1, wherein:

said material of the sole has a tensile strength in traction less than 30 MPa.

17. A sole according to claim 1, wherein:

said material of the sole is a synthetic rubber-based material.

18. A sole according to claim 1, wherein:

the anchoring element is affixed to the sole by having the sole overmolded around the anchoring element.

19. A sole according to claim 1, wherein:

each of the two connecting members comprises an active portion; and the active portions of the two connecting members are spaced apart by 50 mm when at rest.

20. A sole according to claim 1, wherein:

the central zone of the anchoring element has a wall thickness in a range of between 1.0 mm and 2.5 mm.

21. A sole according to claim 1, wherein:

the central zone of the anchoring element has a wall thickness in a range of between approximately 1.0 mm and approximately 2.5 mm.

22. A sole according to claim 20, wherein:

the anchoring element is made of a glass fiber-reinforced polyamide.

23. A sole according to claim 21, wherein:

the anchoring element is made of a glass fiber-reinforced polyamide.

24. A sole according to claim 1, wherein:

a longitudinally extending groove having a height opening to a lower extent of the sole;

each of the two connecting members having an active portion extending transversely across said groove, said active of each of the two connecting members being entirely contained within the height of the groove.

25. A cross-country ski boot comprising:

a sole having a flexibility to allow a rear end of the sole to be raised and lowered relative to a cross-country ski during skiing;

an upper connected to and extending upwardly from said sole;

said sole comprising:

two connecting members for connecting the sole to a binding device;

material of the sole, the two connecting members being anchored to the material of the sole;

each of the two connecting members further comprising anchoring portions anchoring the two connecting members in the material of the sole at respective positions along a length of the sole to allow the rear end of the sole to be raised and lowered relative to the ski during skiing when the connecting members are connected to the binding device;

an anchoring element, both of the two connecting members extending from the anchoring element, the anchoring element being distinct from but affixed to said the material of the sole at a predetermined section of the sole;

the anchoring element comprising two anchoring zones, each of the anchoring portions of the two connecting members being fixed to a respective one of the two anchoring zones of the anchoring element;

the anchoring element further comprising a central zone, the central zone of the anchoring element extending between the two anchoring zones, the central zone of the anchoring element being flexible and sufficiently flexible relative to a flexibility of the sole to enable a flexing of the predetermined section of the sole to which the anchoring element is affixed.

26. A sole according to claim 1, wherein:

the predetermined section of the sole and the central zone of the anchoring element are made of different materials.

27. A cross-country ski boot according to claim 25, wherein:

the predetermined section of the sole and the central zone of the anchoring element are made of different materials.

28. A sole according to claim 1, wherein:

said material of the sole has a tensile strength of less than 20 MPa.

29. A sole according to claim 1, wherein:

said material of the sole has a tensile strength of less than 30 MPa;

at least the central zone of the anchoring element is made of a material having a bending modulus less than 6000 MPa; and the central zone of the anchoring element has a wall thickness in a range of between approximately 1.0 mm and approximately 2.5 mm.

30. A sole according to claim 29, wherein:

said material of the sole has a tensile strength of less than 20 MPa.

31. A sole according to claim 1, wherein:

the central zone of the anchoring element extends no further than within a single plane from a first lateral edge to a second lateral edge.

32. A cross-country ski boot according to claim 25, wherein:

the central zone of the anchoring element extends no further than within a single plane from a first lateral edge to a second lateral edge.

33. A sole for a cross-country ski boot, said sole comprising:

two connecting members for connecting the sole to a binding device;

material of the sole, the two connecting members being anchored to the material of the sole;

each of the two connecting members further comprising anchoring portions anchoring the two connecting members in the material of the sole at respective positions along a length of the sole to allow a rear end of the sole to be raised and lowered relative to the ski during skiing when the connecting members are connected to the binding device;

an anchoring element, both of the two connecting members extending from the anchoring element, the anchoring element being distinct from but affixed to the material of the sole at a predetermined section of the sole;

the anchoring element comprising two anchoring zones, each of the anchoring portions of the two connecting members being fixed to a respective one of the two anchoring zones of the anchoring element;

the anchoring element further comprising a central zone, the central zone of the anchoring element extending between the two anchoring zones, the central zone of the anchoring element being flexible and sufficiently flexible relative to a flexibility of the material of the sole to enable a flexing of the predetermined section of the sole to which the anchoring element is affixed;

the anchoring element has a length;

each of the two connecting members comprises an active portion;

the active portions of the two connecting members are longitudinally spaced apart a greater distance than the length of the anchoring element at least when the sole is not flexed.

34. A cross-country ski boot comprising:

a sole having a flexibility to allow a rear end of the sole to be raised and lowered relative to a cross-country ski during skiing;

an upper connected to and extending upwardly from said sole;

said sole comprising:

two connecting members for connecting the sole to a binding device;

material of the sole, the two connecting members being anchored to the material of the sole;

each of the two connecting members further comprising anchoring portions anchoring the two connecting members in the material of the sole at respective positions along a length of the sole to allow the rear end of the sole to be raised and lowered relative to the ski during skiing when the connecting members are connected to the binding device;

an anchoring element, both of the two connecting members extending from the anchoring element, the anchoring element being distinct from but affixed to said the material of the sole at a predetermined section of the sole;

the anchoring element comprising two anchoring zones, each of the anchoring portions of the two connecting members being fixed to a respective one of the two anchoring zones of the anchoring element;

the anchoring element further comprising a central zone, the central zone of the anchoring element extending between the two anchoring zones, the central zone of the anchoring element being flexible and sufficiently flexible relative to a flexibility of the sole to enable a flexing of the predetermined section of the sole to which the anchoring element is affixed;

the anchoring element has a length;

each of the two connecting members comprises an active portion;

the active portions of the two connecting members are longitudinally spaced apart a greater distance than the length of the anchoring element at least when the sole is not flexed.

35. A ski boot comprising:

a sole comprising at least one constituent material, the sole extending longitudinally between a front end and a rear end;

an upper affixed to and extending upwardly from the sole;

two connecting members, each of the two connecting members having an exposed portion structured and arranged to be connected to a binding device;

the exposed portions of the two connecting members being positioned, relative to the sole, to bind the ski boot to a ski by means of the binding device, while the rear end of the sole is free to be raised and lowered relative to the ski;

an anchoring part, distinct from the constituent material of the sole, affixed to the constituent material of the sole, the anchoring part comprising two longitudinally spaced-apart zones;

the two connecting members extending from respective ones of the two spaced-apart zones of the anchoring part;

the anchoring part further comprising a central zone, the central zone of the anchoring part extending longitudinally along a predetermined length of the sole between the two spaced-apart zones;

the central zone of the anchoring part being longitudinally flexible to allow a relative displacement between the exposed portions of the two connecting members during raising and lowering of the rear end of the sole relative to the ski during skiing.

36. A sole according to claim 35, wherein:

the sole has a longitudinally flexibility to flex along the predetermined length of the sole during raising and lowering of the rear end of the sole relative to the ski during skiing.

37. A sole according to claim 35, wherein:

the constituent material of the sole has a longitudinally flexibility to flex along the predetermined length of the sole during raising and lowering of the rear end of the sole relative to the ski during skiing.

38. A sole according to claim 36, further comprising:

a downwardly open longitudinally extending groove;

the exposed portions of the two connecting members extending transversely across the groove.

39. A sole according to claim 38, wherein:

the groove is transversely demarcated by a plurality of tread blocks on each side of the groove, said tread blocks constituting downwardly extending projections having lowermost tread surfaces;

a plurality of transversely extending slits in said tread surfaces, said slits facilitating the longitudinal flexibility of the sole.

40. A sole according to claim 39, wherein:

the plurality of slits comprise at least a transversely aligned pair of slits on opposite sides of the groove.

41. A sole according to claim 40, wherein:

the transversely aligned pair of slits are positioned longitudinally between the exposed portions of the two connecting members.

42. A sole according to claim 35, wherein:

the relative displacement of the exposed portions of the two connecting members corresponds to a relative angular offset of at least 5 degrees.

43. A ski boot comprising:

a sole comprising at least one constituent material, the sole extending longitudinally between a front end and a rear end;

an upper affixed to and extending upwardly from the sole;

two connecting members, each of the two connecting members having an exposed portion structured and arranged to be connected to a binding device;

the exposed portions of the two connecting members being positioned, relative to the sole, to bind the ski boot to a ski by means of the binding device, while the rear end of the sole is free to be raised and lowered relative to the ski;

an anchoring part, distinct from the constituent material of the sole, affixed to the constituent material of the sole, the anchoring part comprising two longitudinally spaced-apart zones;

the two connecting members extending from respective ones of the two spaced-apart zones of the anchoring part;

the anchoring part further comprising a central zone, the central zone of the anchoring part extending longitudinally along a predetermined length of the sole between the two spaced-apart zones;

the central zone of the anchoring part being longitudinally flexible to allow a relative displacement between the exposed portions of the two connecting members during raising and lowering of the rear end of the sole relative to the ski during skiing;

the anchoring element has a length;

each of the two connecting members comprises an active portion;

the active portions of the two connecting members are longitudinally spaced apart a greater distance than the length of the anchoring element at least when the sole is not flexed.

* * * * *